US006405658B1

(12) United States Patent
Taylor

(10) Patent No.: US 6,405,658 B1
(45) Date of Patent: Jun. 18, 2002

(54) MANUAL DISCHARGE DOOR OPERATING SYSTEM FOR A HOPPER RAILCAR

(75) Inventor: Fred J. Taylor, Florence, KY (US)

(73) Assignee: JAC Patent Company, Johnstown, PA (US)

( * ) Notice: Subject to any disclaimer, the term of this patent is extended or adjusted under 35 U.S.C. 154(b) by 0 days.

(21) Appl. No.: 09/584,571

(22) Filed: May 31, 2000

Related U.S. Application Data

(60) Provisional application No. 60/137,021, filed on Jun. 1, 1999.

(51) Int. Cl.[7] ..... B61D 7/18

(52) U.S. Cl. ..... 105/286; 105/284; 105/290; 105/299

(58) Field of Search ..... 105/286, 290, 105/299, 240, 284, 250

(56) References Cited

U.S. PATENT DOCUMENTS 1,418,907 A * 6/1922 Campbell ..... 105/240
1,444,730 A * 2/1923 Christianson ..... 105/240
1,584,436 A * 5/1926 Cemean ..... 105/240
3,187,684 A * 6/1965 Ortner ..... 105/240
3,596,609 A * 8/1971 Ortner et al. ..... 105/240
3,608,500 A * 9/1971 Floehr ..... 105/240
3,611,947 A * 10/1971 Nagy ..... 105/290
3,654,873 A * 4/1972 Floehr ..... 105/248
3,786,764 A * 1/1974 Beers, Jr. et al. ..... 105/240
3,815,514 A * 6/1974 Heap ..... 105/240
3,818,842 A * 6/1974 Heap ..... 105/240
3,949,681 A * 4/1976 Miller ..... 105/284
4,163,424 A * 8/1979 Lindauer ..... 105/290
4,222,334 A * 9/1980 Peterson ..... 105/250
4,224,877 A * 9/1980 Stark et al. ..... 105/250
4,366,757 A * 1/1983 Funk ..... 105/250
4,601,244 A * 7/1986 Fischer ..... 105/240
4,741,274 A * 5/1988 Ferris et al. ..... 105/240
5,249,531 A * 10/1993 Taylor ..... 105/290
5,823,118 A * 10/1998 Manstrom ..... 105/284

* cited by examiner

*Primary Examiner*—S. Joseph Morano
*Assistant Examiner*—Lars A. Olson
(74) *Attorney, Agent, or Firm*—Webb Ziesenheim Logsdon Orkin & Hanson, P.C.

(57) ABSTRACT

A manual discharge door operating system for a hopper railcar includes a door actuation shaft coupled to the railcar extending across the width of the railcar. The door actuation shaft has distal ends accessible from opposite sides of the railcar with each distal end adapted to be engaged with a handle for rotation of the actuation shaft by the operator. Rotation of the actuation shaft opens and closes the discharge door of the hopper railcar through linkage assemblies. Preferably, a door operating linkage assembly is provided with an over-center closed position to hold the door in the closed position.

17 Claims, 1 Drawing Sheet

MANUAL DISCHARGE DOOR OPERATING SYSTEM FOR A HOPPER RAILCAR

This application claims the benefit of U.S. Provisional Patent Application Ser. No. 60/137,021, filed Jun. 1, 1999, entitled "Manual Door Operating System".

BACKGROUND OF THE INVENTION

1. Field of the Invention

The present invention relates generally to an apparatus for opening the rotating discharge doors of a railway hopper car, and in particular, to an apparatus for manually opening the rotating hopper car discharge doors from either side of the hopper car by a single operator.

2. Description of the Prior Art

A common type of railroad freight car in use today is the open top freight car of the type wherein the load may be discharged through hoppers on the underside of the body. Such cars are generally referred to as hopper cars and are used to haul coal, phosphate and other commodities. After hopper cars are positioned over an unloading pit, the discharge doors of the hoppers are opened, allowing the material within the hopper car to be emptied into the pit. There are several methods available for opening and closing the hopper doors.

U.S. Pat. No. 3,596,609, issued to Ortner et. al., describes a system for simultaneously opening rotating hopper doors using a longitudinally extending operating rod connected to actuating shafts extending transversely below the hopper car body. Each door operating lever rotates an actuating shaft which in turn actuates a linkage mechanism to open and close the doors.

U.S. Pat. No. 4,741,274, issued to Ferris et. al., also describes a system for operating hopper dump doors on a railway hopper car. The lever is comprised of a single plate body portion with pivotal connections. The pivotal connections are coplanar with the door operating struts in a substantially vertical plan passing through the vertical transverse centerline of the center sill of the car to eliminate unnecessary rotational movements of the mechanism.

Other prior art references that teach operating mechanisms for opening and closing hopper doors include U.S. Pat. No. 3,187,684 to Ortner; U.S. Pat. No. 3,611,947 to Nagy; U.S. Pat. No. 3,786,764 to Beer et al.; U.S. Pat. No. 3,815,514 to Heap; U.S. Pat. No. 3,818,842 to Heap; U.S. Pat. No. 3,949,681 to Miller; U.S. Pat. No. 4,222,334 to Peterson; U.S. Pat. No. 4,366,757 to Funk; U.S. Pat. No. 4,601,244 to Fischer; and U.S. Pat. No. 5,823,118 to Angstrom. There are several disadvantages to the hopper door operating mechanisms described in some of the above-cited patents. One problem is that some of the prior art mechanisms are designed such that each actuating mechanism is connected to doors from two separate hoppers. Thus, if the mechanism fails, it effects the operation of two hoppers. Another disadvantage of some of the above described hopper door mechanisms is that, since the mechanisms are designed to operate doors from two adjacent hoppers, the mechanisms must push the doors closed with compressive forces being delivered to the mechanisms. This design makes it necessary to periodically adjust the mechanism as the system wears. In addition, the compressive forces applied to the hopper doors in closing may cause buckling problems. A further disadvantage of some of the above-described hopper cars is that the operating mechanisms limit the distance of the door motion, thus limiting the open area of the car bottom. This arrangement slows the unloading process and causes additional costs and potential damage to the car such as due to increased periods in thaw sheds.

Another prior art reference is Applicant's earlier U.S. Pat. No. 5,249,531 (hereinafter referred to as "Applicant's earlier '531 patent") entitled "Railroad Hopper Car Door Actuating Mechanism", which issued on Oct. 5, 1993.

I addressed these problems in developing the railroad hopper car door actuating mechanism described in my earlier '531 patent (hereinafter referred to as "my earlier '531 patent") which is incorporated herein by reference in its entirety. The door operating mechanism described in my prior patent does not provide for manual operation.

SUMMARY OF THE INVENTION

It is an object of the present invention to provide a manual mechanism for actuating the discharge doors of a hopper car which maintain some of the advantages of my prior invention. It is also an object of the present invention to provide a door actuating mechanism which does not need periodic adjustment to allow for wear of the parts. It is a further object of this invention to provide a door operating system for a hopper car in which the closing and lockup of the hopper doors are in tension, as opposed to compression type mechanisms. It is a further object of the present invention to provide a system which provides a significant opening in the bottom of a hopper car in order to allow quick and safe discharge of its contents. It is a further object of the present invention to provide a door operating system in which each door assembly has a positive over-center locking mechanism. It is a further object of the present invention to provide a mechanism that can be retrofitted into existing hopper cars as well as incorporated into new construction.

These and other objects may be accomplished by the manual railroad hopper door actuating mechanism of my invention. The manual railroad hopper door actuating mechanism includes a manually rotatable door actuation shaft that is accessible from either side of the railcar. The door actuation shaft rotates a first pivot arm that is coupled to a second door actuating pivot arm through a first linkage arm. A second door actuating linkage arm extends between the pivot connecting the first linkage arm and the second pivot arm and the hopper door pan for actuating the door. Rotation of the actuating shaft in a first direction will open the hopper door and rotation in the opposite direction will shut the hopper door. The door operating mechanism maintains the over-center closed configuration described in my earlier '531 patent.

These and other advantages of the present invention will be clarified in the brief description of the preferred embodiments together with the attached figures wherein like reference numerals represent like elements throughout.

DESCRIPTION OF THE PREFERRED EMBODIMENTS

Figure 1:
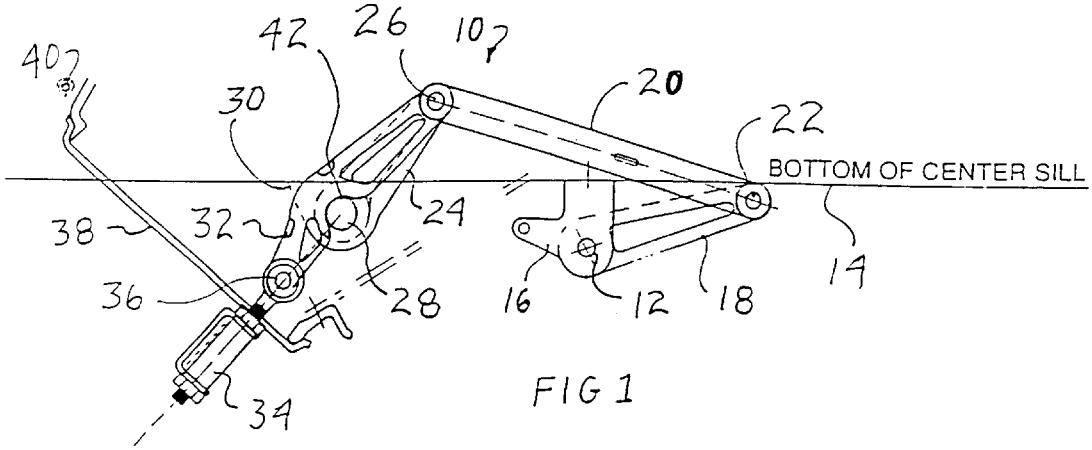
FIG. 1 is a schematic side view of the manual door actuating mechanism of my invention in its closed position.
Figure 2:
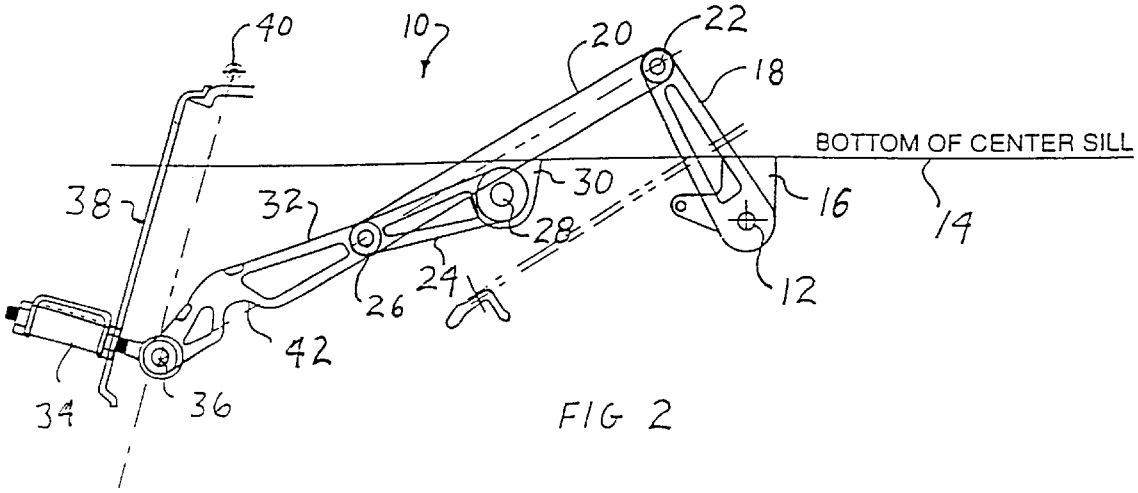
FIG. 2 is a schematic side view of the manual door actuating mechanism shown in FIG. 1 in the open position.

The construction of a standard hopper railcar is well-known in the industry and is described in greater detail in my earlier '531 patent, which is incorporated herein by reference. FIGS. 1 and 2 schematically illustrate the manual railroad hopper door actuating mechanism 10 of my invention.

The door actuating mechanism 10 includes a rotatable door actuation shaft 12 rotatably mounted to a center sill 14 of the railcar through mounting bracket 16. The door actuation shaft 12 extends across the width of the railcar and is accessible by the operator on either side of the railcar. The door actuation shaft 12 may include a coupling, aperture or the like (not shown) at the distal ends thereof for receipt of an actuating handle/leverage bar for rotation of the actuation shaft 12 by the operator. Any conventional coupling for receipt of the handle will be sufficient. Further, the handle may simply be an elongated steel bar. Further, frame members along the sides of the railcar, such as side sills (not shown), may also additionally include mounting brackets for locating the actuation shaft 12. The support for the actuation shaft 12 is not limited to a single bracket 16.

A first pivot arm 18 is attached to the actuation shaft 12 for rotation therewith as will be described hereinafter. A distal end of the pivot arm 18 is pivotably attached to one end of a first linkage arm 20 by a pivot pin 22. An opposite end of the linkage arm 20 is pivotably attached to a distal end of a second pivot arm 24 by a pivot pin 26. An opposite end of the pivot arm 24 is mounted for rotation about the axis of a pin 28. Pin 28 is mounted to the center sill 14 by a bracket 30. One end of a second, door operating linkage arm 32 is pivotably attached to the arm 20 and the arm 24 by pin 26. The second end of the linkage arm 32 is attached to a door spreader 34 through coupling pin 36. The door spreader 34 extends across a door pan 38 and is attached thereto on opposite sides of the center sill 14. The door pan 38 pivots about a hinge pin 40 to move between the open and closed positions. The linkage arm 32 includes a cutout 42 which rests against the pin 28 in the over-center closed position shown in FIG. 1.

The spreader 34, linkage arm 32 including cutout 42, pivot arm 24 and pin 28 are similar to the elements in my prior door operating mechanism discussed in my earlier '531 patent. The present invention is specifically intended to maintain the same advantages provided by these elements discussed in my earlier '531 patent. This also makes retrofitting of the present invention particularly simple in those railcars incorporating the door operating design of my earlier '531 patent. The present invention is also easily retrofitted to hopper railcars that do not include the design of my earlier '531 patent. There is no special equipment needed to retrofit an existing railcar with the present design. Additionally, there are no special tools needed for operating the door operating mechanism of the present invention.

A lock (not shown) may be provided to prevent unwanted actuation of the door actuating mechanism 10. The lock can take any desired form. For example, a gear or ratchet wheel may be secured to the shaft 12 with a locking pawl releasably engaged with the gear or ratchet wheel. The locking pawl could be pivotably mounted on the bracket 16 for pivoting into and out of locking engagement with the shaft 12. Other types of positive locking arrangements are possible.

In operation, the operator disengages the lock and rotates the actuation shaft 12 in the counterclockwise direction from the position shown in FIG. 1 to open the door pan 38. As discussed above, the operator can access the shaft 12 from either side of the railcar and will use an engaging handle, typically a steel bar or the like. Counterclockwise (referencing FIG. 1) rotation of the shaft 12 will rotate the first pivot arm 18 counterclockwise with the shaft 12 about the axis of the shaft 12 and move the attached linkage arm 20 to the left, pivoting the second pivot arm 24 counterclockwise about the axis of the pin 28. This movement will shift the linkage 32 to pivot the door pan 38 about hinge pin 40 to open the hopper doors as shown in FIG. 2. The open position is shown in FIG. 2. Closing the door pan 38 is simply the opposite procedure through the clockwise rotation (as shown in FIG. 2) of the shaft 12. The over-center locking of the door actuating mechanism 10 is such that by swinging the door pans 38, when the door pans 38 are open and the commodity has been fully discharged, the door pans 38 will actually swing shut and lock. The cantilever action of the pivot arms 18 and 24 and first linkage arm 20 uses the weight of the door structure to pull itself closed.

The manual railroad hopper door actuating mechanism 10 of my invention is designed for safe, flexible, economical unloading of coal and other bulk materials from railroad cars. The manual railroad hopper door actuating mechanism 10 of my invention maintains some of the advantages of my earlier automatic design.

The over-center door mechanism provides simple operation and reduces the possibility of back injury to the operator. The system requires virtually no readjustment or maintenance. Additionally, when the railcar is operated in rotary discharge operation, the manual railroad hopper door actuating mechanism 10 of my invention will maintain the hopper doors closed during the rotary dumping. The manual railroad hopper door actuating mechanism 10 of my invention requires only one operator who can actuate the system from either side of the car. The system can be easily retrofitted into existing cars, even cars with worn or damaged doors or that have uneven door spacing.

While the invention has been shown and described with regard to a particular embodiment, it will be understood that my invention is not limited to this particular embodiment. Many changes and modifications may be made to the present invention without departing from the spirit and scope thereof. For example, the door operating mechanism can be designed to open a double set of door pans. This modification of the door operating linkage is shown in my earlier '531 patent. Further modifications are within the scope of the present invention.

What is claimed is:

1. A manual discharge door operating system for a hopper railcar, the system comprising:

a door actuation shaft coupled to the railcar and extending across the width of the railcar, wherein one distal end of the shaft is accessible by an operator on either side of the railcar and wherein each distal end of the shaft is manually engagable for rotation by the operator;

a door operating linkage assembly coupled to the railcar and attached to at least one discharge door, the linkage assembly operable to open and close the attached at least one discharge door, wherein the door operating linkage assembly maintains an over-center closed configuration when the at least one discharge door is closed, wherein the door operating linkage includes:

(i) a door operating linkage arm extending from at least one discharge door; and (ii) a door pivot arm rotationally coupled to the railcar at a position spaced from the door actuation shaft and having a distal end pivotally attached to an end of the door operating linkage arm spaced from the at least one discharge door; and a control linkage assembly attached to the door actuation shaft and the door operating linkage assembly wherein rotation of the door actuation shaft will move the door operating linkage assembly through the control linkage assembly for opening and closing of the at least one discharge door, wherein the control linkage assembly includes:

(i) a control pivot arm attached to the door actuation shaft; and (ii) a control linkage arm pivotally attached at one end thereof to a distal end of the control pivot arm and an opposite end thereof pivotally attached to both the door operating linkage arm and the door pivot arm at a common pivot point.

2. The door operating system of claim 1, wherein the door operating linkage further includes:

i) a door spreader attached to one discharge door, ii) the door operating linkage arm having one end thereof pivotably coupled to the door spreader and an opposite end thereof pivotably attached to the control linkage arm and the door pivot arm, and iii) a stop coupled to the railcar, wherein the door operating linkage arm abuts against the stop in the over-center closed position.

3. The door operating system of claim 2, wherein the stop is a pivot pin coupling the pivot arm of the door operating system to the railcar.

4. The door operating system of claim 3, wherein the door operating linkage arm includes a cutout which abuts against the stop.

5. The door operating system of claim 3, wherein the stop is mounted to a center sill of the railcar through a bracket.

6. The door operating system of claim 1, further including a bracket mounting the actuation shaft to a center sill of the railcar.

7. The door operating system of claim 1, further including a lock selectively preventing rotation of the door actuation shaft.

8. A manual door operating system for a discharge door of a hopper railcar, the system comprising:

a door actuation shaft rotationally attached to the railcar and extending transverse to the railcar, the actuation shaft having a first distal end engagable by an operator on a first lateral side of the railcar, and a second distal end engagable by the operator on a second lateral side of the railcar, wherein the operator can manually engage and rotate the actuation shaft through either distal end;

a control pivot arm attached to the door actuation shaft;

a control linkage arm attached to a distal end of the control pivot arm;

a door operating linkage arm attached to the control linkage arm and coupled to one discharge door of the railcar, wherein rotation of the actuation shaft will selectively open and close the discharge door; and a second pivot arm pivotally attached to the railcar at one end at a position spaced from the door actuation shaft and the second pivot arm pivotally attached to both the linkage arms at a common pivot point at an opposite end thereof.

9. The door operating system of claim 8, further including a mounting bracket rotationally mounting the actuation shaft and attached to the center sill of the railcar.

10. The door operating system of claim 8, further including a door spreader attached to the one discharge door on opposite sides of a center sill of the railcar and having the door actuating linkage arm attached to the door spreader.

11. The door operating system of claim 8, further including a stop attached to the railcar wherein the door operating linkage arm abuts against the stop when the discharge door is in a closed position.

12. The door operating system of claim 11, wherein the closed position is an over-center closed position wherein gravity will hold the one discharge door in the closed position.

13. A manual door operating system for a discharge door of a hopper railcar comprising:

a door actuation shaft rotationally attached to the railcar extending transversely thereto;

shaft rotation means on each side of the railcar engagable by an operator for manual rotation of the actuation shaft from either side of the railcar; and a door operating means coupled to the railcar and at least one discharge door for moving the door between an open and a closed position, wherein the door operating means is driven by the manual rotation of the door actuation shaft, wherein the door operating means includes a door operating linkage assembly to open and close the at least one discharge door and a control linkage assembly extending between the door actuation shaft and the door operating linkage assembly, wherein a control linkage assembly includes a control pivot arm attached the door actuation shaft thereof, a control linkage arm pivotally attached to an opposite end of the control pivot arm, the control linkage arm attached to the door operating linkage assembly, the door operating linkage assembly including a linkage arm extending from the door and attached at one end thereof to the control linkage arms, and a door pivot arm attached to the railcar at a position spaced from the door actuation shaft, wherein the door pivot arm is pivotally attached to both the door operating linkage arm and the control linkage arm at a common pivot point.

14. The door operating system of claim 13, wherein the shaft rotation means includes the distal ends of the actuation shaft, each distal end engagable with a rotation handle carried by the operator.

15. The door operating system of claim 13, wherein the door operating linkage assembly maintains an over-center closed configuration when the at least one discharge door is in the closed position.

16. The door operating system of claim 13, wherein the control linkage assembly includes a pivot arm attached to the actuation shaft and a control linkage arm extending from the pivot arm to the door operating linkage assembly.

17. The door operating system of claim 13, further including a bracket rotationally mounting the actuation shaft and attached to a center sill of the railcar.

* * * * *